US009611640B2

(12) United States Patent
Mayer et al.

(10) Patent No.: US 9,611,640 B2
(45) Date of Patent: Apr. 4, 2017

(54) WALL FRAMING SYSTEM

(71) Applicant: Adirondack Group, LLC, Minnetonka, MN (US)

(72) Inventors: Scott C. Mayer, Minnetonka, MN (US); Karl A. Sherry, Minnetonka, MN (US); David M. Nichols, Minnetonka, MN (US)

(73) Assignee: Adirondack Group, LLC, Minnetonka, MN (US)

( * ) Notice: Subject to any disclaimer, the term of this patent is extended or adjusted under 35 U.S.C. 154(b) by 0 days.

(21) Appl. No.: 14/867,204

(22) Filed: Sep. 28, 2015

(65) Prior Publication Data

US 2016/0017600 A1 Jan. 21, 2016

Related U.S. Application Data

(62) Division of application No. 13/784,125, filed on Mar. 4, 2013, now abandoned.

(60) Provisional application No. 61/608,911, filed on Mar. 9, 2012.

(51) Int. Cl.

| | |
|---|---|
| ***E04C 2/34*** | (2006.01) |
| ***E04C 3/00*** | (2006.01) |
| ***E04B 1/74*** | (2006.01) |
| ***E04B 2/56*** | (2006.01) |
| ***E04B 2/74*** | (2006.01) |
| ***E04B 1/76*** | (2006.01) |
| ***E04B 2/72*** | (2006.01) |
| *E04B 1/00* | (2006.01) |

(52) U.S. Cl.

CPC ..... *E04B 2/562* (2013.01); *E04B 1/7608* (2013.01); *E04B 1/7675* (2013.01); *E04B 2/72* (2013.01); *E04B 2/7457* (2013.01); *E04B 1/0007* (2013.01)

(58) Field of Classification Search

CPC ..... E04B 2/7457; E04B 2/767; E04B 2/78; E04B 2/7881; E04B 1/7675; E04B 2/60; E04B 2/7863; E04B 2/562; E04B 1/7608; E04B 2/72; E04C 2003/0434; E04C 2003/0452

USPC ..... 52/481.1, 837, 407.1

See application file for complete search history.

(56) References Cited

U.S. PATENT DOCUMENTS

| | | | |
|---|---|---|---|
| 1,334,398 | A | 3/1920 | Plym et al. |
| 1,994,976 | A | 3/1935 | Wread |
| 2,682,087 | A | 6/1954 | Siering |
| 3,058,551 | A | 10/1962 | Martin |
| 3,101,817 | A | 8/1963 | Radek |
| 3,293,813 | A | 12/1966 | Emmons et al. |

(Continued)

FOREIGN PATENT DOCUMENTS

| | | |
|---|---|---|
| EP | 1312725 | 5/2003 |
| NZ | 572197 | 4/2010 |

*Primary Examiner* — Phi A
*Assistant Examiner* — Omar Hijaz
(74) *Attorney, Agent, or Firm* — Haugen Law Firm PLLP

(57) ABSTRACT

A wall framing system for supporting an interior wall in spaced proximity to an exterior wall includes one or more stud members extending between upper and lower frame channel members, which are configured to self-locate in relation to the exterior wall in a manner which establishes a moisture and air barrier between the exterior wall and the interior wall supported by the wall framing system. The interior wall supported by the wall framing system is resistant to moisture degradation, and maintains desired R-value insulation properties throughout the wall.

6 Claims, 11 Drawing Sheets

(56) References Cited

U.S. PATENT DOCUMENTS

| | | | | |
|---|---|---|---|---|
| 3,333,390 | A * | 8/1967 | Banning | E04B 2/76 52/355 |
| 3,368,312 | A | 2/1968 | Shore | |
| 3,570,199 | A | 3/1971 | Gartner | |
| 3,744,199 | A | 7/1973 | Navarre | |
| 3,940,899 | A | 3/1976 | Balinski | |
| 3,950,912 | A | 4/1976 | Lundberg et al. | |
| 3,998,027 | A | 12/1976 | Wendt et al. | |
| 4,011,704 | A | 3/1977 | O'Konski | |
| 4,047,355 | A * | 9/1977 | Knorr | E04B 2/7409 52/302.3 |
| 4,152,873 | A | 5/1979 | Burke | |
| 4,350,459 | A | 9/1982 | Bryant | |
| 4,361,994 | A | 12/1982 | Carver | |
| 4,408,427 | A | 10/1983 | Zilch | |
| 4,430,832 | A | 2/1984 | Kaiser et al. | |
| 4,443,991 | A | 4/1984 | Mieyal | |
| 4,621,470 | A | 11/1986 | Balinski | |
| 4,899,509 | A | 2/1990 | Power | |
| 5,062,250 | A | 11/1991 | Buzzella | |
| 5,146,723 | A | 9/1992 | Greenwood et al. | |
| 5,245,811 | A | 9/1993 | Knorr | |
| 5,950,385 | A | 9/1999 | Herren | |
| 5,956,909 | A | 9/1999 | Chou | |
| 6,098,355 | A | 8/2000 | Li | |
| 6,145,257 | A | 11/2000 | Cappuccio | |
| 6,216,404 | B1 | 4/2001 | Vellrath | |
| 6,345,478 | B1 | 2/2002 | Pang | |
| 6,553,731 | B2 | 4/2003 | Hsueh et al. | |
| 6,571,523 | B2 | 6/2003 | Chambers | |
| 6,959,520 | B2 | 11/2005 | Hartman | |
| 7,096,629 | B1 | 8/2006 | Cox | |
| 7,461,494 | B2 * | 12/2008 | Frezza | E02D 27/00 52/241 |
| 7,665,264 | B1 | 2/2010 | Wolfe | |
| D623,768 | S | 9/2010 | Antonic | |
| D625,844 | S | 10/2010 | Antonic | |
| 7,810,289 | B2 | 10/2010 | Montgomery | |
| 7,900,411 | B2 | 3/2011 | Antonic | |
| 8,001,736 | B2 | 8/2011 | Goldberg et al. | |
| 8,020,352 | B2 | 9/2011 | Ahearn | |
| 8,407,954 | B2 * | 4/2013 | Keith | E04B 2/8652 52/204.1 |
| 2003/0115818 | A1 | 6/2003 | Weurman | |
| 2004/0118061 | A1 | 6/2004 | Little | |
| 2007/0068111 | A1 | 3/2007 | Buntain | |
| 2007/0193143 | A1 | 8/2007 | Antonic | |
| 2008/0196337 | A1 | 8/2008 | Surowiecki | |
| 2009/0229219 | A1 | 9/2009 | Rutman et al. | |

* cited by examiner

WALL FRAMING SYSTEM

CROSS-REFERENCE TO RELATED APPLICATIONS

This application is a divisional of U.S. Non-Provisional patent application Ser. No. 13/784,125, filed on Mar. 4, 2013, and entitled "WALL FRAMING SYSTEM," which itself claims priority to U.S. Provisional Patent Application Ser. No. 61/608,911, filed on Mar. 9, 2012 and entitled "WALL FRAMING SYSTEM", the contents of which being incorporated herein in their entirety.

FIELD OF THE INVENTION

The present invention relates to wall construction generally, and more particularly to systems and methods for constructing insulated interior walls or wall sections in a manner which minimizes moisture accumulation and damage to the interior wall as a result of condensation or other moisture intrusion pathways.

BACKGROUND OF THE INVENTION

Improvements in construction materials, construction methods, and more stringent local and state building codes have contributed to improved energy efficiency in new building construction and remodeled insulated wall structures for homes and buildings.

Conventional construction techniques employed to obtain relatively high insulation values involve a wall frame which supports insulation between an exterior wall or cladding, and an interior finishing surface of the wall. In some cases, polymer membranes are applied to the exterior cladding or sheathing as a water-impermeable barrier that nonetheless permits air exchange into and out from the wall. Additionally, low permeability polymer barriers are oftentimes applied to an inner portion of the wall structure, encasing the insulation between the inner low permeability polymer barrier and the exterior wall, casing, or cladding, with or without the presence of a gas-transmissive membrane at the exterior side of the wall.

Though the above-described arrangement has proven effective in creating a relatively high insulative value (R-value), the combination of an interior side vapor barrier has the tendency to cause moisture retention in the wall structure, which can undesirably lead to mold growth within the wall, degradation of the wall, insects, and/or other moisture related problems. The source of moisture within the wall structure is oftentimes condensation that occurs between a warm surface and a cold surface. The condensation typically forms as a result of warm and humid interior air moving to a cold exterior surface of the wall in winter months, or warm and humid exterior air moving to a relatively cold interior surface of the wall in summer months due to air conditioning. Not only does the retained moisture of condensation impact the structure of the wall itself, it can also reduce the insulative performance by creating a "liquid bridge" of relatively high thermal conductivity through the wall. Once moisture has accumulated in the wall, it is typically difficult with conventional construction arrangements to dry out the wall, or to maintain the moisture below a concentration that is potentially detrimental to the structural or performance characteristics of the wall. Drying of accumulated moisture, such as from condensation, is particularly challenging with high R-value wall constructions, which inhibit air movement through the wall.

In addition to conventional wall construction approaches of light timber framing supporting blown, rolled, or sheet insulation between upright framing studs, structural insulated panels have also been employed as pre-formed modular building panels. The structural insulation panels may be of a sandwich construction with an insulating foam core covered on each side by a sheeting material such as plywood or oriented strand board (OSB). Structural insulation panels may alternatively be a non-sandwich design which incorporates structural studs embedded or partially embedded in an insulation material. Such structural insulation panels may be formed by molding insulation material about, or bonding insulation material to one or more structural studs, which may typically be manufactured from steel or other inorganic material. Consequently, many modular wall panels available today utilize wood or metal framing construction studs in combination with an expanded polystyrene (EPS) foam.

Modular wall panels are useful in residential and commercial building construction since they make the assembly of wall frames more efficient. Essentially, a wall frame may be constructed simply by joining a series of preformed wall panels to one another. Conventional structural insulation wall panels, however, have also failed to adequately address the problem of moisture entrapment between external cladding and the building panels or other framework.

A particular application in the construction of insulated walls, either through conventional techniques or through modular structural insulated panels, is in the construction of insulated walls in a basement against or in proximity to the exterior foundation wall. While the construction of basement finishing walls is similar in many ways to the construction of above-ground exterior walls, construction of basement finishing walls is oftentimes undertaken by homeowners who are not necessarily skilled in best construction practices. Moreover, basement constructions are well known for moisture entrapment, such that techniques for limiting or preventing excessive moisture retention within the walls becomes particularly important in the basement setting. Conventional construction techniques also commonly employ wood structural components, which are susceptible to degradation in the presence of moisture.

Builders have recognized the need for constructing walls from materials which are resistant to moisture degradation, and to at least separate materials that are susceptible to moisture damage from a moisture source, such as the concrete wall of a basement foundation. However, no systems have been developed to date which permit both efficient and consistent construction of walls that are both resistant to damage by moisture, and prevent a "liquid bridge" between the moisture source and the interior of the wall surface so as to maintain a desirably high R-value insulation property.

It is therefore an object of the present invention to provide a wall construction system that is resistant to moisture degradation, and establishes an effective interior air barrier to limit condensation at an exterior sheathing as a result of moisture-laden interior warm air from reaching the cool exterior sheathing or wall.

It is another object of the present invention to provide a wall framing system that permits the efficient construction of a wall with a capillary break between the wall and an exterior sheathing or wall.

It is a still further object of the present invention to provide a wall framing system of materials which are resistant to degradation by moisture, and may include recycled content.

It is a further object of the present invention to provide a wall construction kit that facilitates the construction of a "best-practices" wall by non-professional builders.

SUMMARY OF THE INVENTION

By means of the present invention, an interior wall that is resistant to moisture damage may be quickly and easily constructed. The interior wall is supported by the wall framing system that is configured to self-locate in relation to an exterior wall or sheathing in a manner which establishes a pre-defined air gap between the interior wall and the exterior wall or sheathing. In doing so, the wall framing system "automatically" establishes a separation which minimizes the likelihood of moisture contact with the interior wall, and specifically the insulation and wall board components of the interior wall. Additionally, the wall framing system of the present invention is manufactured from materials which are resistant to moisture degradation, and are not supportive of the growth of microorganisms such as mold or mildew.

A wall framing system of the present invention for supporting an interior wall in spaced proximity to an exterior wall includes upper and lower frame channel members each having a base portion extending between an inner brace portion and an outer brace portion. The inner and outer brace portions of the upper and lower frame channel members extend substantially perpendicularly outwardly from the brace portion in a common direction to define a channel therebetween. The upper and lower frame channel members further include a stand off portion extending from the outer brace portion by a first dimension for abutment against the exterior wall to space the outer brace portion from the exterior wall by the first dimension. The wall framing system further includes a stud member that is receivable in the channels of the upper and lower frame channel members. The stud member includes substantially parallel outer and inner flanges connected by a web portion, and a major divider portion extending substantially in parallel to the outer and inner flanges from a central region of the web portion between the outer and inner flanges to define a plurality of distinct major receptacles between the outer and inner flanges. A first major receptacle has a first width defined between the outer flange and the major divider portion, and a second major receptacle has a second width defined between the inner flange and the major divider portion, with the first and second widths of the first and second major receptacles being different. Selected ones of the major receptacles are capable of supporting an insulation member between the upper and lower frame channel members, and spaced from the exterior wall. The stud member is engagable with the upper and lower frame channel members through respective interaction between the outer and inner flanges and the outer and inner brace portions.

DETAILED DESCRIPTION OF THE PREFERRED EMBODIMENTS

Figure 1:
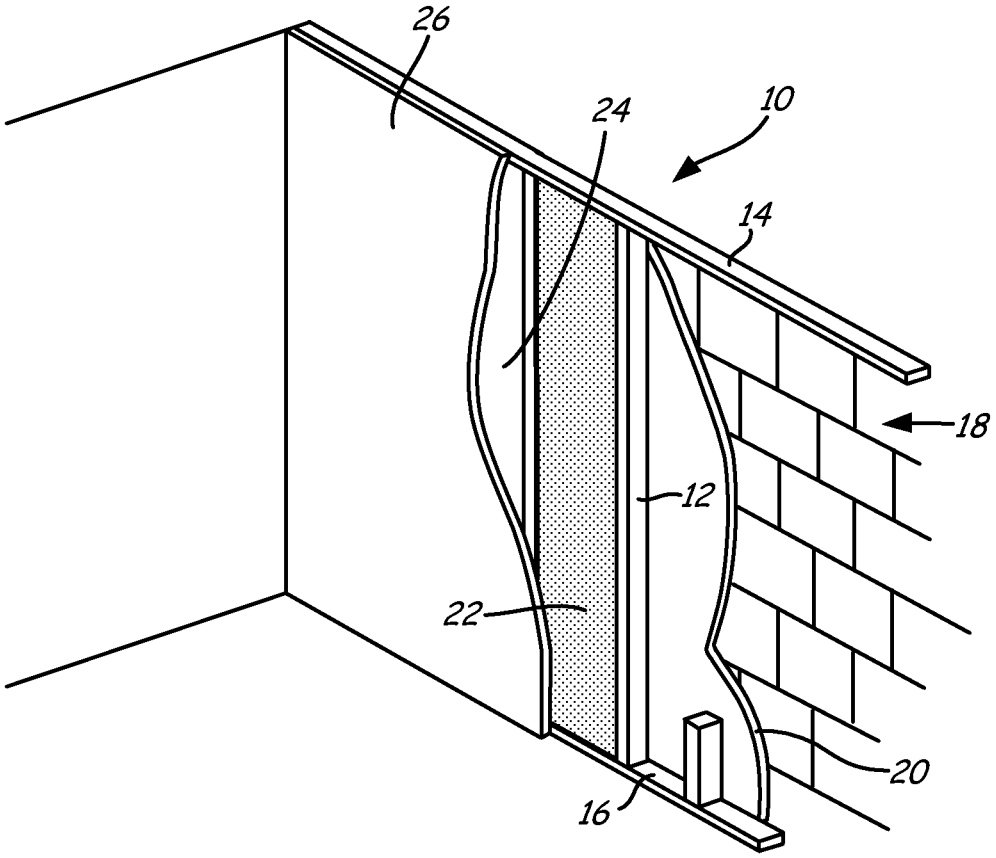
Fig. 1 (Prior Art)
FIG. 1 is a schematic illustration of a conventional interior wall construction.

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Unless otherwise apparent or stated, directional references, such as "upper", "lower", "interior", "exterior", "top", "bottom", "vertical", "horizontal", and the like are intended to be relative to the orientation of a particular embodiment of the invention as shown in the figures. In addition, a given reference numeral in the drawings indicates the same or similar structure when it appears in different figures and like reference numerals identify similar structural elements and/or features of the subject invention.

A conventional approach to the construction of structural walls is illustrated in FIG. 1, including a traditional wood stud framing arrangement 10 with vertical wood studs 12 secured between a wood head rail 14 and a wood base rail 16. The wood stud framing system 10 is positioned either directly or indirectly against or in close proximity to an exterior wall 18. In the illustrated embodiment, exterior wall 18 is a basement foundation wall in the form of masonry block. However, wood stud framing systems 10 are also commonly employed against or in close proximity to exterior sheathing in the form of plywood or oriented strand board in the case of above grade exterior walls. In many conventional applications, a first vapor barrier 20 in the form of rigid insulation foam boards are interposed between exterior foundation wall 18 and framing system 10, though other approaches merely position framing system 10 in direct contact with exterior wall 18.

Typically, a roll-type fiberglass blanket insulation 22 is supported between adjacent vertical wood studs 12 to establish a suitable R-value insulation for the wall. In some cases, a second vapor barrier 24 has been employed for limiting the passage of interior air to exterior wall 18. Second vapor barrier 24 is typically a low-permeability polymer sheeting material, such as polyethylene, and is secured to wall system 10 by various techniques, including stapling the sheeting material second vapor barrier 24 to respective facing surfaces of vertical wood studs 12. Finally, an interior finishing surface 26 is secured to the wall framing system 10 to create a smooth and aesthetic interior wall surface. Interior wall finishing surface 26 is typically "wall board", such as plaster board or gypsum board.

The conventional wall framing system 10 illustrated in FIG. 1 tends to trap moisture between the first and second vapor barriers 20, 24. The retained moisture can promote mold growth both in the insulation 22 and organic wood material of studs 12 and rails 14, 16. Moreover, placing either or both of first vapor barrier 20 and the wood framing system 10 in contact with the exterior wall 18 can result in condensation water penetrating through the wall structure, thereby creating a "liquid bridge" through the wall to degrade the overall R-value of the wall.

Figure 2:
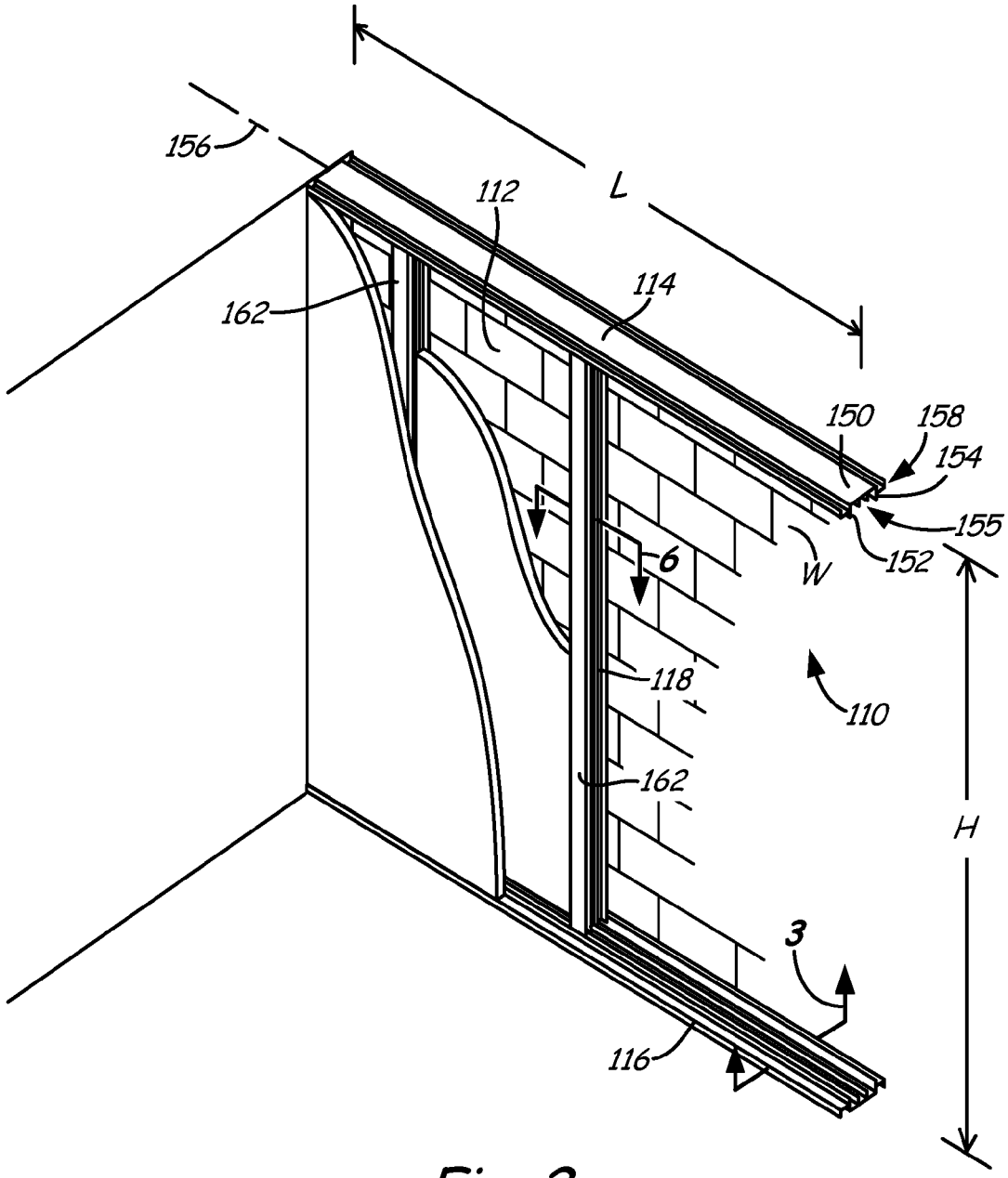
FIG. 2 is a schematic illustration of a wall framing system of the present invention.

An embodiment of a wall framing system 110 of the present invention is illustrated in FIG. 2 for supporting an interior wall 112 in spaced proximity to an exterior wall "W". Wall framing system 110 generally includes upper and lower framed channel members 114, 116, and one or more stud members 118 extending between upper and lower framed channel members 114, 116. While wall framing system 110 is illustrated for supporting interior wall 112 in spaced proximity to exterior wall "W", it is contemplated that wall framing system 110 may be employed for supporting a wall in spaced proximity to exterior sheathing or cladding, instead of exterior wall "W". In a particular application, exterior wall "W" may be a below-grade foundation wall, such as a poured concrete wall, or a masonry block wall, as is commonly employed in the construction industry.

Figure 3:
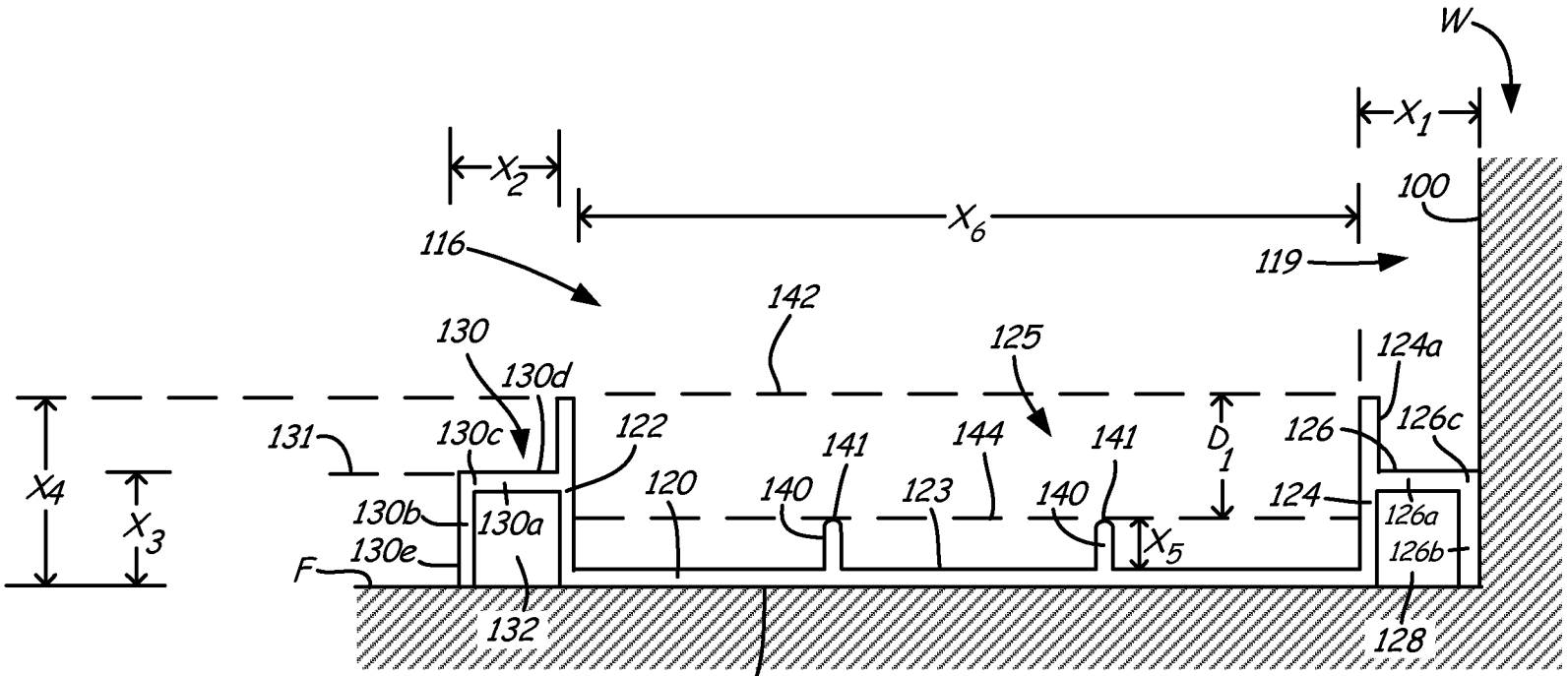
FIG. 3 is a cross-sectional end elevational view of a portion of a wall framing system of the present invention.

A cross-sectional end view of an embodiment of lower frame channel member 116 is illustrated in FIG. 3 positioned on a floor surface "F", and abutted against exterior wall "W". Lower frame channel member 116 includes a base portion 120 extending between an inner brace portion 122 and an outer brace portion 124. For the purposes of the present description, the terms "inner", "outer", "interior", and "exterior" are described with reference to exterior wall "W", wherein an "inner" or "interior" portion is distal from exterior wall "W" with respect to "outer" or "exterior" portions. Inner and outer brace portions 122, 124 extend substantially perpendicularly upwardly from base portion 120 in a common direction to define a channel 125 therebetween.

The illustrated embodiment of lower frame channel member 116 includes a stand off portion 126 extending from an outer surface 124*a* of outer brace portion 124 by a first dimension "$X_1$" for abutment against exterior wall "W" to thereby space outer brace portion 124 from exterior wall "W" by first dimension "$X_1$". Stand off portion 126 may be variously configured to achieve a stand off first dimension "$X_1$" of outer brace portion 124 from exterior wall "W". However, in the illustrated embodiment, stand off portion 126 includes a projecting portion 126*a* extending from outer brace portion 124 by first dimension "$X_1$" defined substantially perpendicularly to inner surface 100 of exterior wall "W". Stand off portion 126 further includes a support portion 126*b* depending from an outer end 126*c* of projecting portion 126*a*. In this configuration, support portion 126*b* desirably acts as a relatively large surface area brace against inner surface 100 of exterior wall "W". Stand off portion 126 may extend continuously or discontinuously along a length "L" of lower frame channel member 116, and supporting portion 126*b* in the arrangement illustrated in FIG. 3 provides support for projecting portion 126*a* in preventing undue deflection of projecting portion 126*a* downwardly toward floor surface "F", as well as for providing a bearing surface for securely positioning lower frame channel member 116 against inner surface 100 of exterior wall "W".

Figure 4:
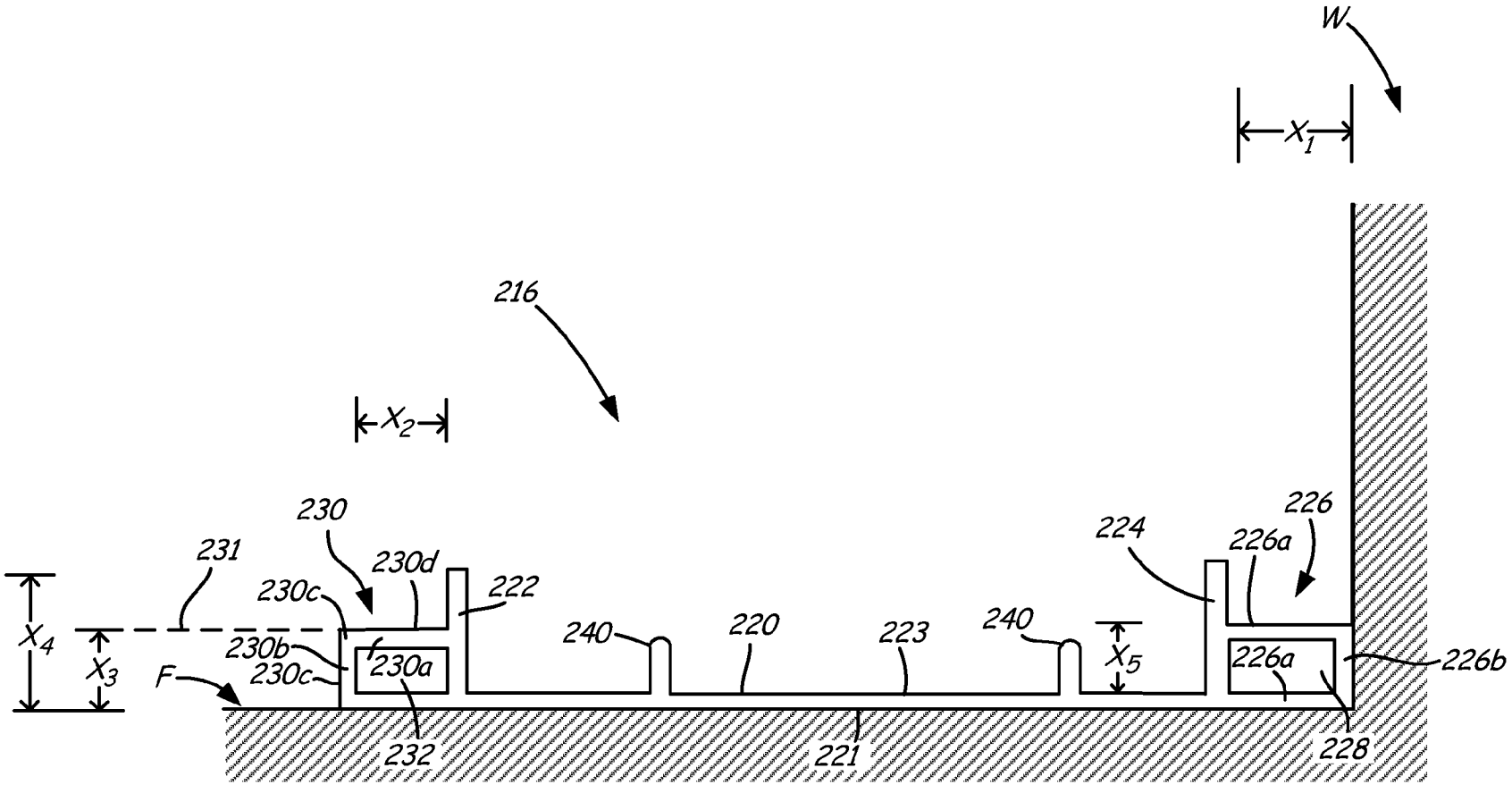
FIG. 4 is a cross-sectional end elevational view of a portion of a wall framing system of the present invention.

Another embodiment for stand off portion 226 is illustrated in FIG. 4, including upper and lower projecting portions 226*a* extending outwardly from outer brace portion 224, and supporting portion 226*b* connecting the upper and lower projecting portions 226*a*. In this embodiment, stand off portion 226 extends from multiple locations at outer brace portion 224, and incorporates a lower projecting portion 226*a* to integrally secure supporting portion 226*b* at upper and lower ends thereof. This arrangement may be considered to provide a sturdy stand off portion 226 for certain applications in which increased loads are anticipated to be placed upon one or more portions of stand off portion 226 and/or shoulder portion 230. The embodiment of lower frame channel member 216 in FIG. 4 is provided as an example of the various configurations of stand off portion 126, 226 contemplated in the present invention.

Figure 5:
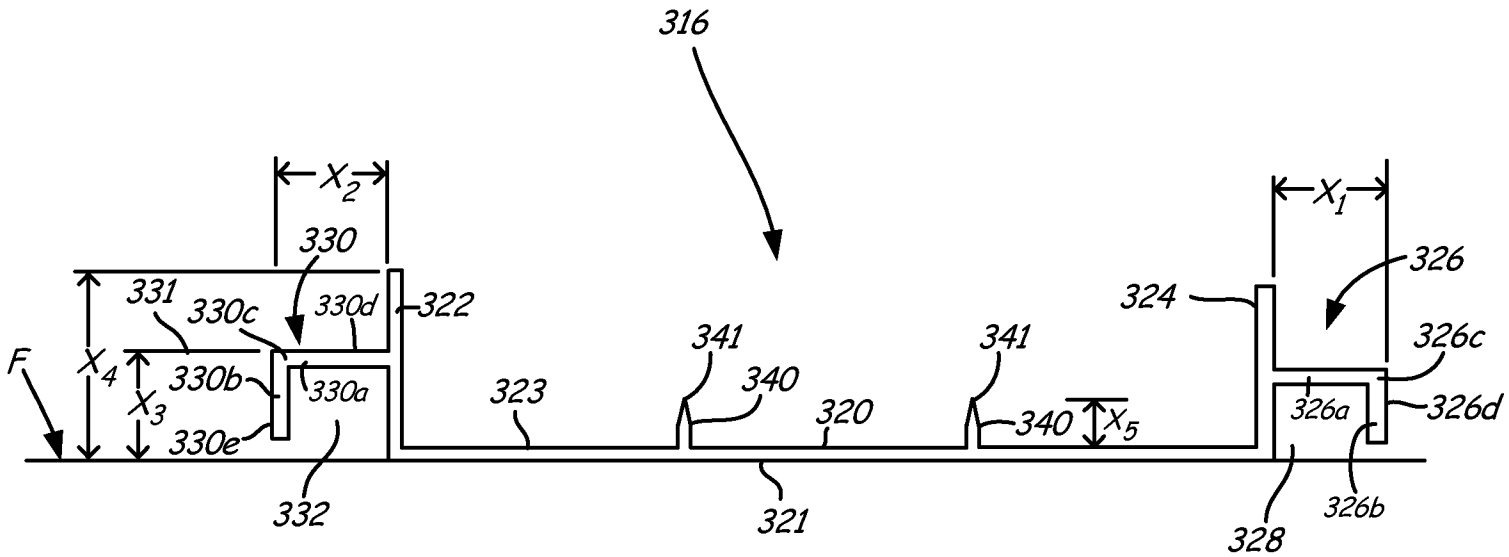
FIG. 5 is a cross-sectional end elevational view of a portion of a wall framing system of the present invention.

Lower frame channel member 316 is illustrated in FIG. 5, including stand off portion 326 extending from outer brace portion 324 by a stand off first dimension "$X_1$". In similarity to stand off portion 126, the embodiment of stand off portion 326 illustrated in FIG. 5 includes a projecting portion 326*a* and a supporting portion 326*b* depending from an outer end 326*c* of projecting portion 326*a*. In this embodiment, however, supporting portion 326*b* does not extend downwardly from projecting portion 326*a* completely to floor surface "F". Supporting portion 326*b*, in this embodiment, provides a bearing surface 326*d* for selectively placing lower frame channel member 316 in direct contact with inner surface 100 of wall "W" for establishing lower frame channel member 316 in proximity to, but spaced from, exterior wall "W".

Stand off portion 126-326 may be integrally formed with outer brace portion 124-324. In some embodiments, lower frame channel member 116-316 is a unitary molded body that is molded from a plastic material that may contain recycled material. The one-piece unitary body construction of lower frame channel member 116-316 provides for strength characteristics, such as at the junction between stand off portion 126-326 and outer brace portion 124-324. As indicated above, stand off portion 126-326 may be variously configured, but is desirably arranged to define a stand off first dimension "$X_1$" when placed against inner surface 100 of exterior wall "W". In some embodiments, stand off portion 126, 326 may further define an outer channel 128-328 along at least a portion of length "L" of lower frame channel member 116-316, with such outer channel 218-328 potentially providing a convenient location for plumbing systems, electrical wires, insulation, telecommunication lines, water barriers, and the like. In typical installations, however, stand off portion 126-326 provides a means for establishing a gap 119 between inner surface 100 of wall "W" and outer brace portion 124-324. The space between inner surface 100 of wall "W" and outer brace portion 124 defines gap 119 of first dimension "$X_1$". Gap 119 defines an air space between exterior wall "W" and an interior wall supported by wall framing system 110. The air space defined by gap 119 forms a "capillary break" between exterior wall "W" and the interior wall supported by wall framing system 110, such that any moisture developed through leakage of exterior wall "W", or condensation developed at inner surface 100 of exterior wall "W" is not in direct contact with the interior wall supported by wall framing system 110. For the purposes hereof, the interior wall "$W_i$" is typically composed of insulation, vertical support studs, a finishing interior surface, such as wall board, and optionally a polymeric vapor barrier disposed between the interior finishing surface and the insulation. However, it is contemplated that other components for interior wall "$W_i$" may be employed in connection with the wall framing system of the present invention.

By establishing a capillary break, gap 119 inhibits the formation of a thermal bridge of water through the interior wall "$W_i$". For instance, moisture collecting at inner surface 100 of exterior wall "W" through condensation, or water penetrating through exterior wall "W" from an exterior environment is out of contact with interior wall "$W_i$", and will either be permitted to evaporate or drain out through conventional drainage systems without coming into contact with interior wall "$W_i$". Not only does gap 119 effectively prevent the creation of a thermal bridge of water through interior wall "$W_i$", but the space also separates any materials susceptible to damage from moisture away from likely contact with moisture. Gap 119 further provides for an air space in which drying air may promote evaporation of any moisture condensed or infiltrated at inner surface 100 of exterior wall "W". It is contemplated that drying air may be supplied to gap 119 through, for example, outer channel 128-328. Appropriate access may be provided for directing drying air through outer channels 128-328 to gap 119. Moreover, provisions may be made for drainage through outer channels 128 of any water collected at gap 119.

The stand off first dimension "$X_1$" is established by the extension of stand off portion 126-326 from outer brace portion 124-324, and may be designed as appropriate for the intended application. In some embodiments, first dimension "$X_1$" may be about 1.25 cm, which has been determined by applicant to provide a gap 119 with adequate space to obtain the beneficial characteristics described above. It has further been determined by the applicant that first dimension "$X_1$" may, in certain applications, be, without limitation, between about 0.5-5 cm.

In some embodiments, lower frame channel members 116-316 may include a shoulder portion 130-330 extending from inner brace portion 122-322 in a general direction opposite of the extension of stand off portion 126-326 from outer brace portion 124-324. In this manner, shoulder portion 130-330 extends "interiorly" from inner brace portion 122-322, along a general direction away from stand off portion 126-326, and away from exterior wall "W" when lower frame channel member 116-316 is positioned for use against or adjacent to exterior wall "W".

In the illustrated embodiments, shoulder portion 130-330 may substantially be a mirror image of stand off portion 126-326. Applicants contemplate, however, that shoulder portion 130-330 may assume a variety of configurations, including configurations independent of the configurations for stand off portions 126-326. The mirror-image arrangement of the illustrated embodiments for lower frame channel members 116-316 exhibit a simplified molded structure which minimizes plastic molding manufacturing costs, and the like.

Shoulder portion 130-330 may include a shoulder extension portion **130*a*-330*a* and a cover portion 130*b*-330*b*. In the illustrated embodiments, cover portion 130*b*-330*b* depends from an interior end 130*c*-330*c* of extension portion 130*a*-330*a*, though Applicants contemplate that shoulder portion 130-330 may be variously configured as needed per the specific application. Shoulder extension portion 130*a*-330*a* may be configured to support a lower edge of an interior wall finishing surface structure, such as a wall board. To this end, shoulder extension portion 130*a*-330*a* may define a second dimension "$X_2$" of about 1.25 cm, which is substantially equal to commonly-employed thicknesses of wall boards and the like utilized in interior wall finishing surfaces. Applicants contemplate, however, that shoulder portion 130-330, including shoulder extension portion 130*a*-330*a*, may be variously configured and, in certain applications, may employ a shoulder extension portion 130*a*-330*a*** of between about 0.5-5 cm.

In some embodiments, shoulder portion 130-330 serves as a mounting surface elevating a wall board or other interior wall finishing surface structure above floor surface "F". By elevating the wall board or the like above floor surface "F", shoulder portion 130-330 of lower frame channel members 116-316 diminish the likelihood that the wall board or other similar structure may be damaged in a minor flooding event of water upon floor surface "F". Such minor flooding events are not uncommon in below-grade basements, wherein water may infiltrate through leaking plumbing pipes, or may seep through foundation cracks from an exterior environment. Shoulder portion 130-330 may be configured to provide an elevated base upon which wall board or other interior wall finishing structure may be placed to avoid the potential of prolonged contact with water in the event of a minor flooding event.

The mounting pedestal provided by shoulder extension portion **130*a*-330*a*** may further be beneficial for elevating the wall board or other interior wall finishing surface structure above floor surface "F" in preventing damage from every day use, and as a consistent and level mounting pedestal for installing the wall board at the interior wall "$W_i$".

Shoulder portion 130-330 may have a pedestal surface **130*d*-330*d* that is vertically spaced from a bottom surface 121-321 of base portion 120-320 by a third dimension "$X_3$". The spacing of third dimension "$X_3$" is measured perpendicularly from bottom surface 121-321 of base portion 120-320 to a plane 131-331 coextensive with pedestal surface 130*d*-330*d***. In some embodiments, third dimension "$X_3$" may be about 1.25 cm, through Applicants also contemplate, in some instances, third dimension "$X_3$" being between 0.5-5 cm.

Pedestal surface **130*d*-330*d* may comprise an upper planar surface of shoulder extension portion 130*a*-330*a*, extending substantially perpendicularly to inner brace portion 122-322, and parallel to floor surface "F" upon which lower frame channel member 116-316 may be operably placed. In such a manner, pedestal surface 130*d*-330*d* provides a relatively flat and level surface upon which to mount wall boards or other interior wall finishing surface structures. To provide a shoulder portion 130-330 with strength characteristics suitable for supporting, for example, a wall board, shoulder portion 130-330 may desirably be integrally formed and molded as a unitary body with inner brace portion 122-322**.

Cover portion **130*b*-330*b* of shoulder portion 130-330, in the illustrated embodiments, may form an aesthetic continuance of the interior wall finishing surface mounted at pedestal portion 130*d*-330*d*. Cover portion 130*b*-330*b* may be substantially flush and coplanar with an interior surface of the wall board to provide a visual appearance of a continuous surface extending to or in close proximity to floor surface "F". Cover portion 130*b*-330*b* may have a textured finishing surface 130*e*-330*e* to more readily accept and retain interior finishing materials, such as paint, plaster, wallpaper adhesives, and the like. In addition to providing a visual appearance of a continuous surface flush and coplanar with an interior surface of the wall board, cover portion 130*b*-330*b* provides a surface against which an interior base board may be applied in a manner so that the base board is continuously flush with shoulder portion 130-330 and an interior surface of the wall board. Such a characteristic is in contrast to conventional wall constructions, in which the wall board may typically include a tapered lower edge that is unsuitable for mounting an interior finishing baseboard directly thereto. Instead, interior trim professionals typically add a shim or other structure to the base of the wall board to establish a mounting surface against which the interior base board may be secured in adjacent parallel relationship to the interior surface of the wall board, substantially perpendicular to the floor. Cover portion 130*b*-330*b*** automatically establishes a co-planar surface with the wall board, and eliminates the need for interior trim installers to shim or otherwise modify the bottom edge of the interior wall to appropriately secure an interior finishing baseboard to the wall.

Shoulder portion 130-330 of lower frame channel member 116-316 may be variously configured, as described above. In the illustrated embodiments, shoulder portion 130-330 defines an inner channel 132-332, which may be utilized for concealing electrical wiring, telecommunication lines, plumbing pipes, water barriers, and the like. In the illustrated embodiments, inner channels 132-332 may have a cross-sectional area of about 1 $cm^2$, though larger or smaller inner channels 132-332 are also contemplated in the present invention.

Lower frame channel members 116-316 may include one or more locating ridges 140-340 projecting upwardly from base portion 120-320 into channel 125-325. Locating ridges 140-340 may extend continuously or discontinuously along length "L" of lower frame channel member 116-316, and may extend substantially in parallel to inner and outer brace portions 122-322, 124-324. Locating ridges 140-340 may extend upwardly from brace portion 120-320 by an extent that is between about 10%-50% of a height dimension "$X_4$" of inner and outer brace portions 122-322, 124-324. In some embodiments, height dimension "$X_4$" of inner and outer brace portions 122-322, 124-324 is about 2.25 cm, and may typically be between about 0.5-5 cm. Typically, height dimension "$X_4$" is at least as great as third dimension "$X_3$" of mounting pedestal **130*d*-330*d*, though it is contemplated that, in some embodiments, third dimension "$X_3$" for the height of mounting pedestal 130*d*-330*d* from bottom surface 121-321 may be greater than height dimension "$X_4$" of inner and outer brace portions 122-322, 124-324. Applicants also contemplate embodiments for lower frame channel members 116-316 in which inner and outer brace portions 122-322, 124-324** are unequal in height.

Locating ridges 140-240 preferably extend upwardly from base portions 120-340 by a fifth dimension "$X_5$" that is between about 10%-50% of height dimension "$X_4$" of inner and outer brace portions 122-322, 124-324. Thus, in the illustrated embodiments, fifth dimension "$X_5$" for the height of locating ridges 140-340 may be between about 0.05-2.5 cm. As will be described in greater detail below, locating ridges 140-340 may be provided as retention members for assisting in retaining insulation boards in place between respective stud members 118. To serve such retention assist mechanism, locating ridges 140-340 are preferably of sufficient height "$X_5$" to penetrate into an insulation member placed at lower frame channel member 116-316 between respective stud members 118, and to penetrate the foam insulation member to an extent which creates substantial frictional resistance to relative movement among the insulation member and the respective locating ridge or ridges 140-340. While the extent of penetration into the insulation member for developing a desired degree of frictional resistance to relative motion is largely dependent on the materials and sizes of insulation member involved, Applicants have determined that locating ridges 140-340 may preferably have a height dimension "$X_5$" of at least about 0.5 cm.

Another aspect in the configuration of locating ridges 140-340 is in the reception of stud members 118 into respective channels 125-325 of lower frame channel members 116-316, wherein it is desired that stud members 118 may be retained in respective channels 125-325, and possibly retained therein without separate fastening mechanisms. Therefore, a factor in designing locating ridges 140-340 is in maintaining a depth dimension "$D_1$", as defined between a channel opening plane 142 of channel 125-325 and a horizontal plane 144 passing through upper ends 141-341 of locating ridges 140-340, wherein horizontal plane 144 is substantially parallel to bottom surface 121-321 of base portion 120-320, and of floor surface "F". As stud members 118 are received in channel 125-325, it is desired that stud members 118 may nest therein to a depth that permits secure engagement between stud member 118 and inner and outer brace portions 122-322, 124-324. Therefore, a balance is struck in the extent of projection for the height "$X_5$" of locating ridges 140-340 with respect to height dimension "$X_4$" to simultaneously provide retention assistance for retaining insulation members at channel 125-325, and for permitting adequate depth reception of stud member 118 into channel 125-325, since locating ridges 140-340 can act as a limiting stop for the reception of stud members 118 into channel 125-325.

In some embodiments, locating ridges 140-340 are discontinuously disposed along length "L" of lower frame channel member 116-316, such that locating ridges 140-340 may be absent from selected locations of lower frame channel members 116-316 to permit reception of respective stud members 118 into channels 124-325 to upper surface 123-323 of base portion 120-320. Moreover, locating ridges 140-340 may be omitted altogether.

In the illustrated embodiments, locating ridges 140-340 are substantially equally spaced between inner and outer brace portions 122-322, 124-324 along base portion 120-320. Width dimension "$X_6$" of channel 125-325 may be, in some embodiments, about 10 cm, though Applicants contemplate a variety of width dimension "$X_6$" for lower frame channel member 116-316 to accommodate various widths of respective stud members 118. Through locating ridges 140-340 are illustrated as being substantially equally spaced from one another and from respective inner and outer brace portions 122-322, 124-324, Applicants contemplate a variety of locations for one or more locating ridges 140-340 at base portion 120-320.

In the embodiment illustrated in FIG. 5, locating ridges 340 terminate in pointed ends 341 to facilitate penetration of locating ridges 340 into the insulation members of the interior wall "$W_i$". Other arrangements for locating ridges 140-340 are also contemplated in the present invention.

In typical embodiments, upper frame channel member 114 may be similarly or identically configured with respect to lower frame channel member 116-316, including an inner brace portion 152 and an outer brace portion 154 extending substantially perpendicularly downwardly from base portion 150 in a common direction to define a channel 155 therebetween. In some cases, upper frame channel member 114 is simply a duplicate lower frame channel member 116-316 rotated 180° about a length axis 156, so that channel 155 is in facing relationship with channel 125-325 of lower frame channel member 116-316. In such orientation, upper frame channel member 114 includes a stand off portion 158 that extends from outer brace portion 154 by first dimension "$X_1$" for abutment against exterior wall "W" to space outer brace portion 154 of upper frame channel member 114 from exterior wall "W" by first dimension "$X_1$" to establish gap 119 between exterior wall "W" and outer brace portion 154. Gap 119 may therefore be delineated between exterior wall "W" and lower and upper outer brace portions 124, 154 as an air gap and capillary break, as described above.

In embodiments of wall framing system 110 in which upper frame channel member 114 is a duplicate of lower frame channel member 116-316, but rotated 180° about longitudinal axis 156, shoulder portion 130-330 of lower frame channel member 116-316 becomes stand off portion 158 of upper frame channel member 114. The dual utility of stand off portion 126-326 and shoulder portion 130-330 provides an efficient manufacture of both upper and lower frame channel members 114, 116-316, in which a single molded body may be utilized as either one of upper and lower frame channel members 114, 116-316. First and second dimensions "$X_1$, $X_2$" may therefore be substantially identical, wherein second dimension "$X_2$" of shoulder portion 130-330 effectively becomes first dimension "$X_1$" for stand off portion 158 of upper frame channel member 114 when lower frame channel member 116-316 is inverted to establish an upper frame channel member 114. However, it is to be understood that upper frame channel member 114 may be uniquely configured with respect to lower frame channel member 116-316.

Figure 6:
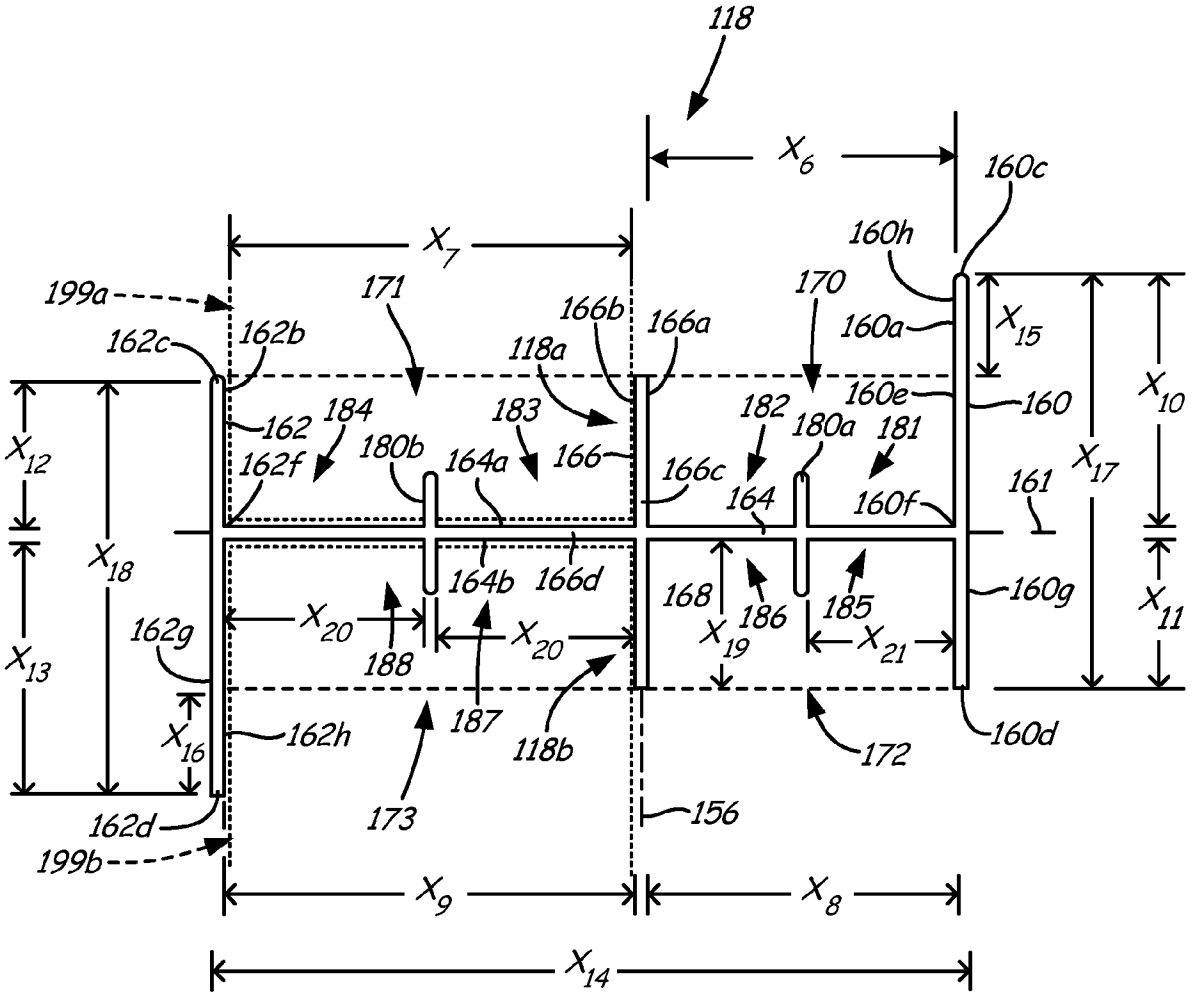
FIG. 6 is a cross-sectional top view of a portion of a wall framing system of the present invention.

Stud member 118 may be configured to be receivable within channels 125-325, 155 of the respective lower and upper frame channel members 116-316, 114, respectively. A cross-sectional end elevational view of stud member 118 is illustrated in FIG. 6, and includes substantially parallel inner and outer flanges 160, 162 connected by a web portion 164. Stud member 118 may further include a major divider portion 166 extending substantially in parallel to inner and outer flanges 160, 162 from a central region 168 of web portion 164 between inner and outer flanges 160, 162 to define a plurality of distinct major receptacles 170-173. Each of major receptacles 170-173 are defined between respective inner or outer flanges 160, 162 and major divider portion 166. In the illustrated embodiment, major divider portion 166 extends outwardly from web portion 164 substantially in parallel to length axis 156, and may extend outwardly from one or both of first and second surfaces 164*a*, 164*b* of web portion 164. In the illustrated embodiment, therefore, each of major receptacles 170, 173 are bounded on three sides by major divider portion 166, web portion 164, and a respective one of inner and outer flanges 160, 162. First major receptacle 170 is bounded on three sides by major divider portion 166, first surface 164*a* of web portion 164, and inner flange 160. Second receptacle 171 is bounded on three sides by major divider portion 166, first surface 164*a* of web portion 164, and outer flange 162. Third major receptacle 172 is bounded on three sides by major divider portion 166, second surface 164*b* of web portion 164, and outer flange 160. Fourth major receptacle 173 is bounded on three sides by major divider portion 166, second surface 164*b* of web portion 164, and outer flange 162.

Major divider portion 166 may extend substantially perpendicularly outwardly from one or both of first and second sides 164*a*, 164*b* of web portion 164, as illustrated in FIG. 6. Major divider portion 166 may extend from central region 168 of web portion 164, but not necessarily equidistantly between inner and outer flanges 160, 162. In fact, Applicants contemplate a preferred embodiment in which major divider portion 166 extends from a location at central region 168 of web portion 164 that is unequally spaced from inner and outer flanges 160, 162. In this embodiment, first major receptacle 170 has a width dimension "$X_6$" defined between outer surface 160*a* of inner flange 160 and inner surface 166*a* of major divider portion 166, which width dimension "$X_6$" is smaller than a width dimension "$X_7$" of second major receptacle 171, as defined between outer surface 166*b* of major divider portion 166 and inner surface 162*b* of outer flange 162. In the illustrated embodiment, first and second portions 166*c*, 166*d* of major divider portion 166 extend perpendicularly outwardly from a common location of web portion 164. Due to the substantially parallel relationships among outer flange 160, inner flange 162, and major divider portion 166, third and fourth receptacles 172,173 exhibit substantially identical width dimension to first and second major receptacles 170, 171, respectively. Therefore, width dimension "$X_8$" of third major receptacle 172 may be substantially identical to width dimension "$X_6$" of first major receptacle 170, and width dimension "$X_9$" of fourth major receptacle 173 may be substantially identical to width dimension "$X_7$" of second major receptacle 171. It is to be understood, however, that second portion 166*d* of major divider portion 166 may extend outwardly from a location at web portion 164 that is spaced from the location at web portion 164 from which first portion 166*c* of major divider portion 166 outwardly extends. In such case, width dimensions "$X_8$, $X_9$" of third and fourth major receptacles 172, 173 are different from width dimensions "$X_6$, $X_7$" of first and second major receptacles 170, 171. Moreover, width dimensions "$X_8$, $X_9$" of third and fourth major receptacles 172, 173 may be equal or different with respect to one another.

As will be described in greater detail hereinbelow, major receptacles 170-173 may be configured with respective width dimensions "$X_6$-$X_9$" that is suitable and capable of supporting insulation member 199 at interior wall "$W_i$", and in an upright orientation between upper and lower frame channel members 114, 116-316, and spaced from exterior wall "W". Example insulation members 199*a*, 199*b* are illustrated in FIG. 6 in phantom depicting an example reception and retention of insulation members 199*a*, 199*b* at second and fourth major receptacles 171, 173. The illustration demonstrates how insulation members 199*a*, 199*b* are respectively retained by frictional forces developed in the contacting engagement of the insulation members 199*a*, 199*b* with respective surfaces 162*b* of outer flange 162 and outer surface 166*b* of major divider portion 166.

In one aspect of the present invention, width dimensions "$X_6$-$X_9$" of major receptacles 170-173 are specifically selected for coordination with standard-width insulation members 199*a*, 199*b*, such that reception of insulation members 199*a*, 199*b* in respective major receptacles 170-173 establishes a retention force in frictionally resisting separation of insulation members 199*a*, 199*b* from stud member 118 to support insulation member 199*a*, 199*b* in an upright orientation at interior wall "$W_i$". In some embodiments, therefore, width dimension "$X_6$" of first major receptacle 170 may be about 3.8 cm, so as to accommodate a standard insulation member width of 1.5 in. In like manner, width dimension "$X_7$" of second major receptacle 171 may be about 5.1 cm to accommodate a standard insulation member width of 2 in. It is understood that width dimensions "$X_6$-$X_9$" of major receptacles 170-173 may be variously configured, and may be specifically sized to accommodate standard-width or non-standard width insulation members. To do so, width dimensions "$X_6$-$X_9$" may be substantially equal to, but slightly larger than, the associated width dimension of insulation member 199*a*, 199*b* to permit reception of insulation member 199*a*, 199*b* to the respective major receptacle 170-173 while simultaneously establishing a contact engagement sufficient to generate a desired degree of frictional retention force between stud member 118 and insulation member 199*a*, 199*b* to maintain the insulation member 199*a*, 199*b* in an appropriate orientation at interior wall "$W_i$".

Inner and outer flanges 160, 162 of stud member 118 may be "offset" from one another, wherein web portion 164 extends from portions from respective inner and outer flanges 160, 162 that may not be precisely centered with respect to first and second ends 160*c*, 160*d* and 162*d*, 162*d* of inner and outer flanges 160, 162. The "offset" relationship between inner and outer flanges 160, 162 is illustrated in the cross-sectional end view of FIG. 6, wherein first portion 160*e* of inner flange 160 extends from an intersection 160*f* with web portion 164 by a dimension "$X_{10}$" to first end 160*c* that is greater than an extension dimension "$X_{11}$" of second portion 160*g* of inner flange 160 from intersection 160*f* to second end 160*d*. However, first portion 162*e* of outer flange 162 extends from intersection 160*f* to first end 162*c* by a dimension "$X_{12}$" that is less than dimension "$X_{13}$" of second portion 162*g* from intersection 162*f* to second end 162*d*. For the purposes of this description, first and second sides 118*a*, 118*b* of stud member 118 may be defined as the respective portions of stud member 118 on a respective first or second side of bisecting plane 161. In some embodiments, bisecting plane 161 substantially bisects web portion 164 throughout dimension "$X_{14}$". In this convention, the illustrated embodiment of inner flange 160 extends a greater distance from bisecting plane 161 at first side 118*a* than outer flange 162. Moreover, inner flange 160 extends to a lesser degree from bisecting plane 161 on second side 118*b*, as compared to outer flange 162. Accordingly, the first offset portion 160*h* with an offset dimension "$X_{15}$" may be established at inner flange 160, while a second offset portion 162*h* with an offset dimension of "$X_{16}$" may be established at outer flange 162. One or more offset portions 160*h*, 162*h* may be provided at stud member 118 as an accessible mounting portion for securing fasteners and the like through inner and/or outer flanges 160, 162 to a respective surface.

In some embodiments, offset dimensions "$X_{15}$, $X_{16}$" of first and second offset portions 160*h*, 162*h* may be substantially equal to simplify the plastic molding procedure. However, it is to be understood that first and second offset portions 160*h*, 162*h* may be dissimilarly configured and/or dimensioned. Inner and outer flanges 160, 162 may also be similarly or substantially identically sized and configured, with length dimension "$X_{17}$" of inner flange 160 being substantially equal to length dimension "$X_{18}$" of outer flange 162. However, Applicants contemplate differing dimensions "$X_{17}$, $X_{18}$" for inner and outer flanges 160, 162. Some example embodiments include a length dimension "$X_{17}$, $X_{18}$" of inner and outer flanges 160, 162 of about 5 cm. In some embodiments, dimension "$X_{11}$" is substantially similar to a dimension "$X_{19}$" of the extension of second portion 166*d* of major divider portion 166 from web portion 164. Moreover, dimensions "$X_{11}$, $X_{19}$" may be substantially similar to dimension "$X_{12}$" of outer flange 162. Such dimensions "$X_{11}$, $X_{12}$, $X_{19}$" may be about 1.85 cm, though various dimensions are contemplated in the present invention. Dimensions "$X_{10}$, $X_{13}$" are illustrated as being larger than dimensions "$X_{11}$, $X_{12}$", and may be about 2.75 cm, though other dimensions are contemplated in the present invention. Offset dimensions "$X_{15}$, $X_{16}$" may be about 1.2 cm, though other dimensions are contemplated in the present invention.

Stud member 118 may further include one or more minor divider portions 180 extending substantially in parallel to major divider portion 166 from web portion 164 to define a plurality of distinct minor receptacles 181-188 between inner and outer flanges 160, 162. In the illustrated embodiment, first minor receptacle 181 is bounded on three sides by inner flange 160, first surface 164*a* of web portion 164, and minor divider portion 180. Second minor receptacle 182 is bounded on three sides by major divider portion 166, first surface 164*a* of web portion 164, and minor divider portion 180. Third minor receptacle 183 is bounded on three sides by major divider portion 166, first surface 164*a* of web portion 164, and a second minor divider portion 180*b*. Fourth minor receptacle is bounded on three sides by second minor divider portion 180*b*, first surface 164*a* of web portion 164, and outer flange 162. Fifth minor receptacle 185 is bounded on three sides by inner flange 160, second surface 164*b* of web portion 164, and first minor divider portion 180*a*. Sixth minor receptacle 186 is bounded on three sides by major divider portion 166, second surface 164*b* of web portion 164, and first minor divider portion 180*a*. Seventh minor receptacle 187 is bounded on three sides by major divider portion 166, second surface 164*b* of web portion 164, and second minor divider portion 180*b*. Eighth minor receptacle 188 is bounded on three sides by outer flange 162, second surface 164*b* of web portion 164, and second minor divider portion 180*b*.

In the illustrated embodiment, minor divider portions 180*a*, 180*b* are respectively equidistantly positioned between major divider portion 166 and respective inner or outer flanges 160, 162. However, such minor divider portions 180*a*, 180*b* need not be so equidistantly positioned. Applicants contemplate that minor divider portions 180*a*, 180*b* serve two primary purposes, with the first purpose being to establish and define a plurality of distinct minor receptacles 181-188 as described above. Minor receptacles 181-188 may be specifically dimensioned to accommodate and cooperate with standard-sized insulation members, such that respective surfaces of minor divider portion 180*a*, 180*b*, and major divider portion 166 or inner or outer flanges 160, 162 to create a contact engagement to retainably receive an insulation member at such respective minor receptacle 181-188. For example, minor receptacles 183, 184, 187, 188 may be provided with a width dimension "$X_{20}$" that is substantially one half of width dimension "$X_7$" of second major receptacle 171. In this example embodiment, width dimension "$X_{20}$" may be about 2.5 cm, which is substantially equal to a 1 inch standard insulation member width. Thus, an insulation member 199*c* having a standard width of 1 inch may be engagably received at a selected one of minor receptacles 183, 184, 187, 188, and retainably secured thereat through the contact force between minor divider portion 180*b* and the respective one of major divider portion 166 and outer flange 162. Multiple insulation members 199 may also be engagably received at selected ones of minor receptacles 181-188, as desired per the application. An example width dimension "$X_{21}$" of minor receptacles 181, 182, 185, 186 may be about 1.85 cm, which is substantially equal to an insulation member standard width of 0.75 in.

A second primary purpose of minor divider portions 180*a*, 180*b* may be to act as retention ridges extending continuously or discontinuously along height "H" of stud member 118. In this regard, minor divider portions 180*a*, 180*b* may act in a similar fashion to locating ridges 140-340 to penetrate and enhance the frictional engagement with one or more insulation members 199 positioned at stud member 118. Such penetration and retention may be most applicable in the event that the insulation member 199 has a width that engagably cooperates with a major receptacle 170-173, so that minor divider portions 180*a*, 180*b* penetrate into the respective insulation member 199 as it is received in the respective major receptacle 170-173.

Figure 7:
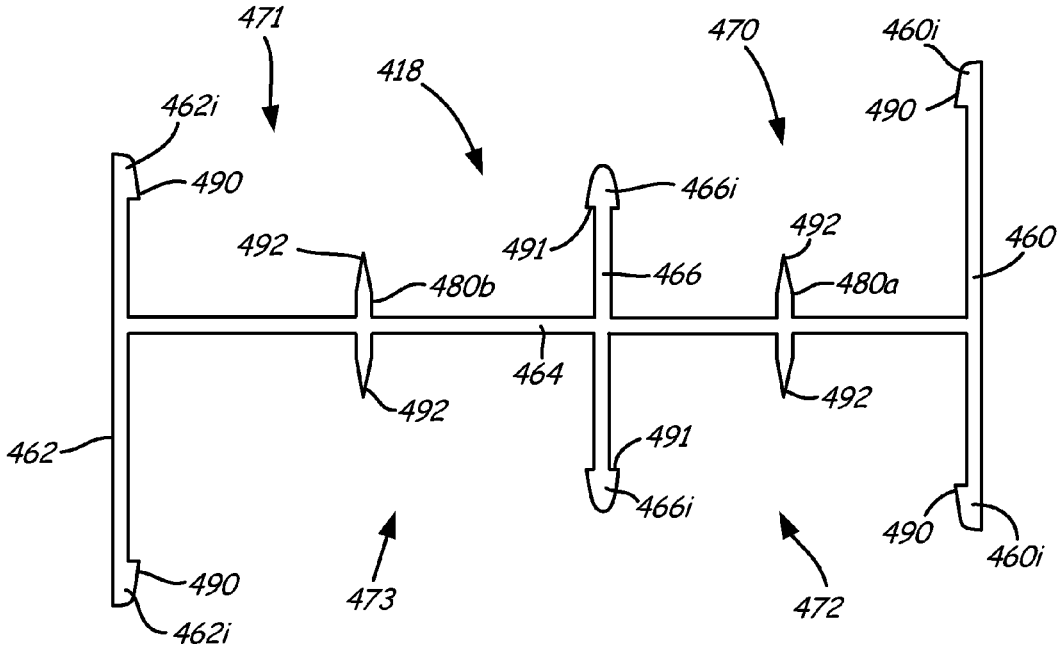
FIG. 7 is a cross-sectional top view of a portion of a wall framing system of the present invention.

Another embodiment of a stud member of the present invention is illustrated in FIG. 7, wherein stud member 418 is similar in many respects to stud member 118. However, end portions 460*i*, 462*i* of inner and outer flanges 460, 462 are provided with projections 490 for enhancing the frictional retention force applied by inner and outer flanges 460, 462 against an insulation member 199 engaged at a respective major receptacle 470-473. Applicants have also determined that such widened portions of inner and outer flanges 460, 462, including projections 490, enhance the strength and rigidity of inner and outer flanges 460, 462.

Major divider portion 466 of stud member 418 may also be provided with an end portion 466*i* including a protrusion 491 for further enhancing the frictional retention of insulation member 199 at major receptacles 470-473. End portions 460*i*, 462*i*, 466*i* not only enhance the frictional retention of insulation member 199 at major receptacles 470-473, but also accommodate width size inconsistencies of insulation members 199, and in deviations of manufacturing tolerances of stud member 118. End portions 460*i*, 462*i*, 466*i* therefore serve to assist in the retention of insulation member 199 at major receptacles 470-473.

Minor divider portions 480*a*, 480*b* of stud member 418 may include pointed end portions 492 distal from web portion 464 to facilitate penetration of minor divider portions 480*a*, 480*b* into the respective insulation member 199. Such utility is similar to that described above with respect to locating ridges 340 of lower frame channel member 316, as described above.

Figure 8:
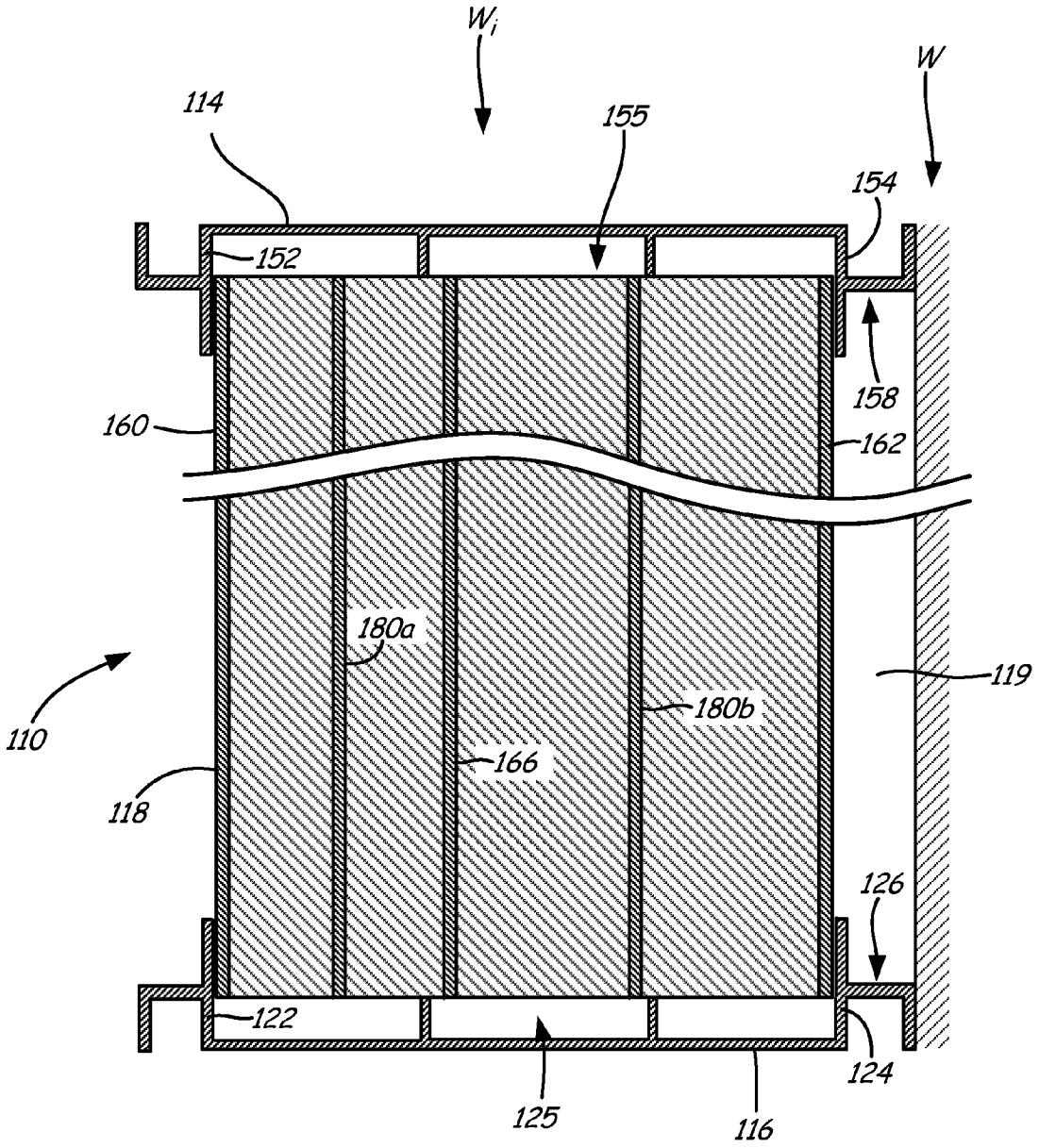
FIG. 8 is a cross-sectional end view of a wall framing system of the present invention.

Stud member 118, 418 may preferably be received in respective channels 125-325, 155 of lower and upper frame channel members 116, 114, respectively. Stud member 118, 418 includes a width dimension "$X_{14}$" that is substantially equal to, but slightly smaller than width dimension "$X_6$" of channel members 116-316, 114. FIG. 8 is a schematic illustration of stud members 118 operably received at respective channels 155, 125 of upper and lower frame channel members 114, 116. Outer flange 162 of stud member 118 may engage with outer brace portion 124, 154 of lower and upper frame channel members 116, 114, respectively, while inner flange 160 of stud member 118 may operably engage inner brace members 122, 152 of lower and upper frame channel members 116, 114, respectively. Therefore, stud member 118 is engagable with upper and lower frame channel members 114, 116 through respective interaction between inner and outer flanges 160, 162 and inner and outer brace portions 122, 152, 124, 154. Applicants anticipate that such interaction may be through frictional retention alone, or may include retention enhancing mechanisms, such as adhesives, fasteners, or the like to secure stud member 118 between upper and lower frame channel members 114, 116. In one aspect of the present invention, however, assembly of wall framing system 110 may preferably be accomplished without separate fastening mechanisms to simplify construction by unskilled users. Consequently, the component parts of wall framing system 110 may be specifically configured to become securely connected to one another merely through frictional retention of physically engaged components. Therefore, wall framing system 110 may be assembled without the need for tools or fasteners. It should be understood, however, that securing wall framing system 110 in proximity to, or in contact with exterior wall "W", may require or be aided with fasteners and/or tools.

Figure 9:
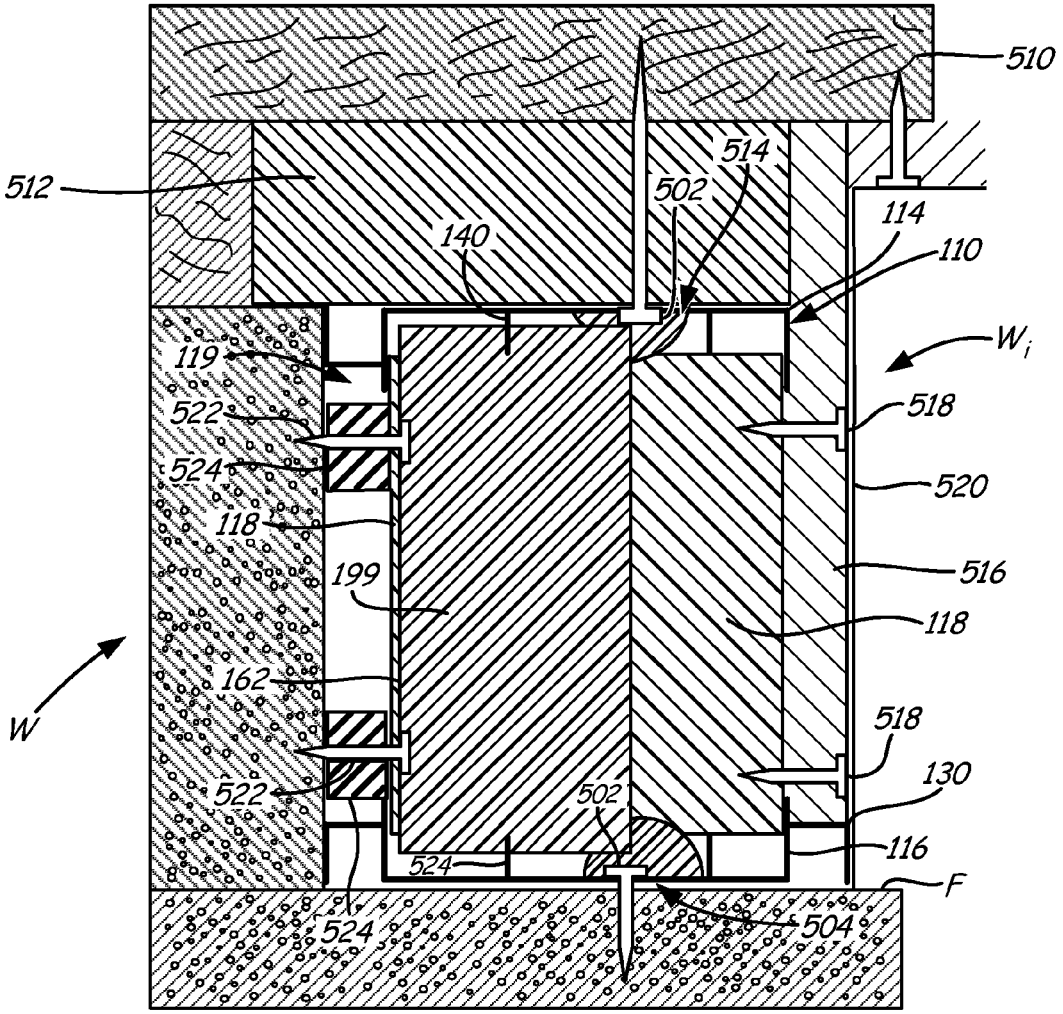
FIG. 9 is a schematic cross-sectional end view of a wall framing system of the present invention.
Figure 10:
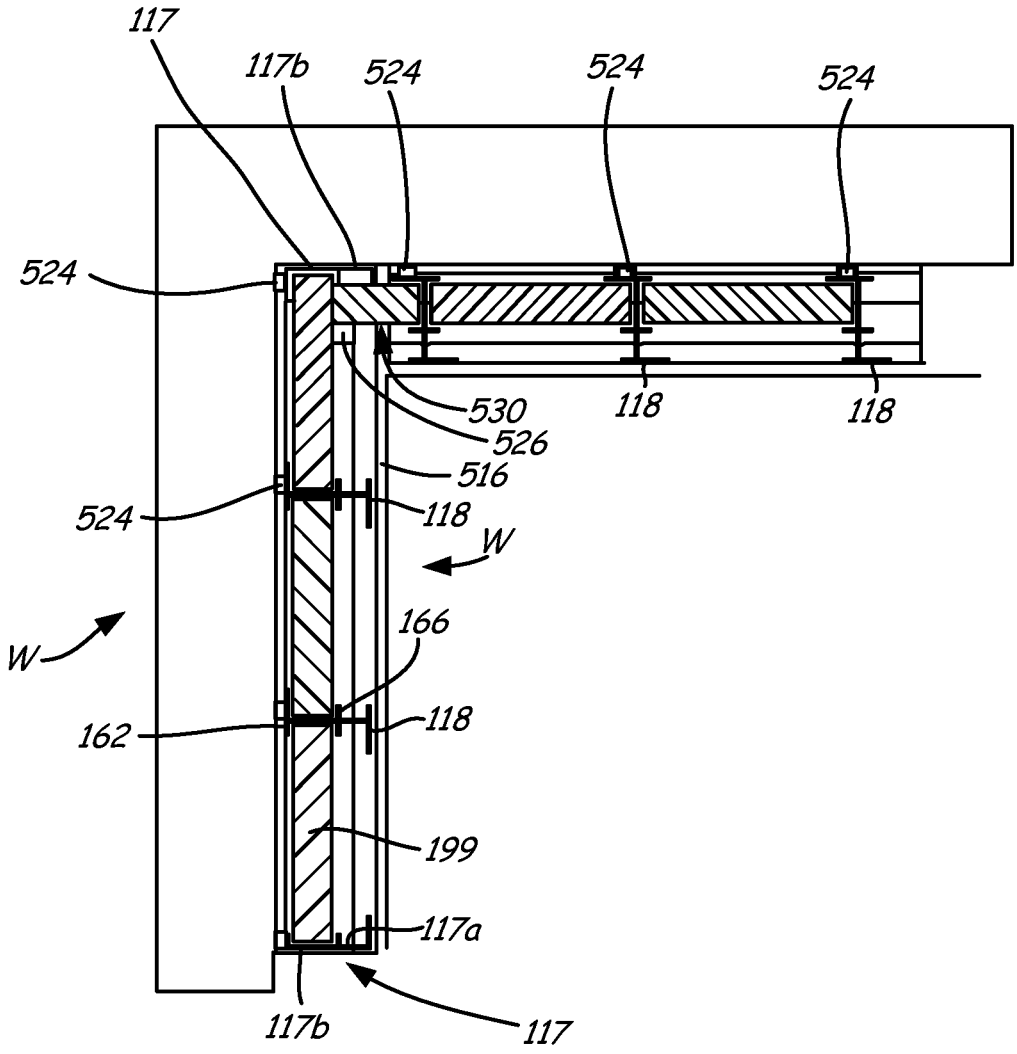
FIG. 10 is a cross-sectional top view of a wall framing system of the present invention.

An example construction for interior wall $W_i$ is illustrated in FIGS. 9 and 10. Interior wall "$W_i$" is supported by wall framing system 110, and includes insulation member 199 secured at major receptacle 171 of stud member 118 between upper and lower frame channel members 114, 116. Insulation member 199 may typically be a rigid, relatively high R-value insulation board of various standard widths. Such insulation member 199 is described in specification 07212 of the Construction Specification Institute (CSI). Insulation member 199 may be penetrated by one or more of locating ridges 140-340 and minor divider portion 180*a*, 180*b*. However, such penetration is not believed to be necessary to retain insulation member 199 at major receptacle 170-173, between major divider portion 166 and outer flange 162. Main channel member 116 may be secured to floor surface "F" with the use of a fastener 502, adhesive 504, or both. Lower frame channel member 116 is preferably abutted against exterior wall "W" by positioning stand off portion 126 in contact with inner surface 100 of exterior wall "W", thereby "self-positioning" channel member 116 in an appropriate location relative to exterior wall "W" to establish a desired gap 119. Lower frame channel member 116 is then secured in place to floor surface "F". Stand off portion 126 provides for simplified positioning of lower frame channel member 116, such that the installer need not measure a spacing distance between inner surface 100 of exterior wall "W" and outer brace portion 124, or the need to position a separate spacer element between outer brace portion 124 and inner surface 100 of exterior wall "W". In this regard, stand off portion 126 permits an "automatic" or "self-positioning" locating of lower frame channel member 116 on floor surface "F" with respect to exterior wall "W" to establish an adequate and consistent gap 119 between interior wall "$W_I$" and exterior wall "W".

Upper frame channel member 114 may be similarly positioned for forming its part of interior wall "$W_i$". In the illustrated embodiment, upper frame channel member 114 may be secured to ceiling joist or board 510 either directly or indirectly through an insulation board 512 with a fastener 502, or the like. Stand off portion 158 of upper frame channel member 114 provides for "automatic" positioning of upper frame channel member 114 with respect to inner surface 100 of exterior wall "W". With such "automatic" positioning means, upper and lower frame channel members 114, 116 (assuming a planar interior surface 100 of exterior wall "W") upper frame channel member 114 is directly vertically aligned with lower frame channel member 116, leaving a consistent gap 119 therebetween. In some embodiments, a sealant material 514 may be utilized between insulation member 199 and upper and lower frame channel members 114, 116. Such sealant further secures insulation member 199 in place, and establishes a complete air barrier to fully encapsulate air gap 119, and to enhance thermal insulation and liquid barrier properties of interior wall "$W_i$".

Interior wall "$W_i$" may further include a wall board 516 supported by shoulder portion 130 of lower frame channel member 116. As illustrated in FIG. 9, wall board 516 may be secured to inner flange 160 of stud member 118 through, for example, fasteners 518. Wall board 516 may be supported above floor surface "F" by dimension "$X_3$", as described above, to limit the potential for damage in the event of a minor flooding event or other damaging environment exposed at floor surface "F". An interior finish coat 520, such as plaster, tape, or other interior surface finishing layer 520 may be applied against wall board 516 in conventional fashion. In the illustrated embodiment, upper frame channel member 114 is secured indirectly to ceiling joist or board 510 through insulation board 512 with fastener 502. In this arrangement, the outer shoulder portion of upper frame channel member 114 is removed, so that wall board 516 extends continuously from shoulder portion 130 to ceiling joist or board 510. In embodiments wherein upper frame channel member 114 is secured directly to ceiling joist or board 510, outer shoulder portion of upper frame channel member 114 may remain in place, so that wall board 516 extends between respective shoulder portions of upper and lower frame channel members 114, 116.

As described above, stud member 118 may "float" by being secured only in the frictional engagement with upper and lower frame channel members 114, 116. In some embodiments, however, it may be desired to further secure stud member 118 to exterior wall "W" with fasteners 522. In such embodiment, commercially available spacer blocks 524 may be positioned between outer flange 162 and inner surface 100 of exterior wall "W" to maintain gap 119 of a substantially consistent dimension "$X_1$" when fasteners 522 secure outer flange 162 of stud member 118 to exterior wall "W". Preferably, spacer blocks 524 have a width dimension that is substantially equivalent to first dimension "$X_1$" of gap 119.

As best illustrated in the top schematic view of FIG. 10, end studs 117 may be provided which include inner and outer flanges 160, 162, major divider portion 166, and minor divider portions 180*a*, 180*b* extending outwardly in only a single direction from web portion 164. In such a manner, inner and outer flanges 160, 162, major divider portion 166, and minor divider portions 180*a*, 180*b* of end stud 117 may extend to only first side 117*a* of bisecting plane 161, such that second side 117*b* of web portion 164 is substantially planar. Second side 117*b* of end stud 117 may therefore be mounted substantially flush against an adjoining section of interior wall "$W_i$", or an inner surface of exterior wall "W".

Separate insulation members 199 may be adjoined or placed in close proximity with one another with conventional approaches, and may be sealed together with, for example, a spray foam material 526. Notches may be provided at respective upper and lower surfaces of insulation member 199 to accommodate crossing over inner brace portion 122 and shoulder portion 130, such as at crossover junction 530.

Figure 11:
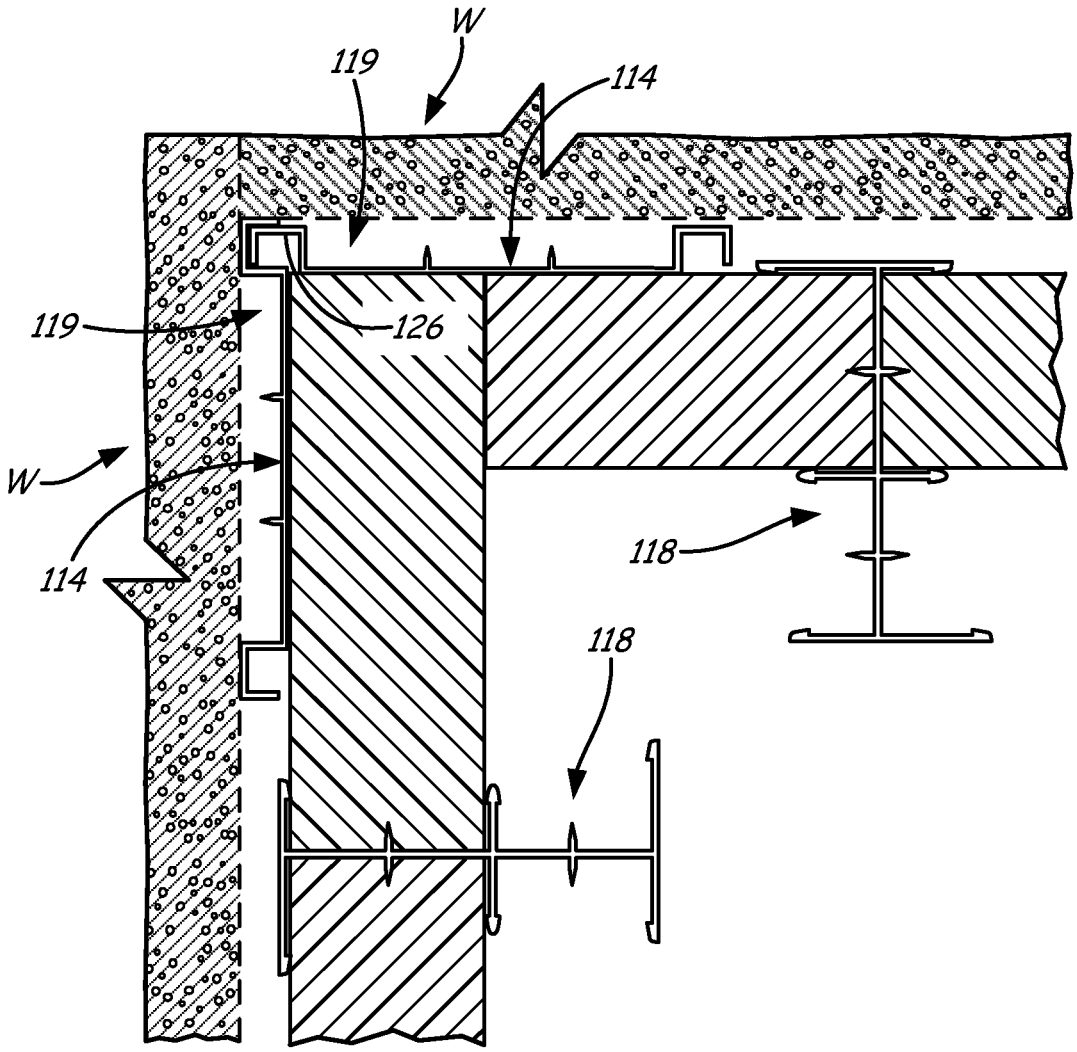
FIG. 11 is a cross-sectional top view of a wall framing system of the present invention.

Another technique for providing framework for interior wall "$W_i$" at an interior corner is illustrated in FIG. 11, wherein two frame channel members 114 may be oriented in parallel to stud members 118, but at an exterior surface of interior wall "$W_i$" and adjacent respective exterior walls "W". The frame channel members 114 may be positioned at the interior corner of exterior wall "W" in a manner to maintain air gap 119 between interior wall "$W_i$" and exterior wall "W". In the illustrated embodiment, respective standoff portions 126 may be nested together at the interior corner of exterior wall "W".

It is contemplated that many applications of wall framing system 110 may support a construction of interior wall "$W_i$" utilizing only some of major and/or minor receptacles 170-173, 181-188 to support and retain insulation members 199 to achieve a desired R-value insulation for interior wall "$W_i$". In the arrangement illustrated in FIGS. 9 and 10, for example, insulation members 199 are operably secured at respective sets of outer major receptacles 170-173, thereby leaving inner major receptacles 170-173 unused. However, such space may be efficiently utilized by installers to place electrical wiring, telecommunication lines, plumbing pipes, and so on in the open space between inner flange 160 and major divider portion 166 of each stud member 118, as well as the associated space between adjacent stud members 118. Therefore, a convenient location for HVAC systems, electrical wiring, plumbing pipes, and the like is provided in the interior wall "$W_i$" supported by wall framing system 110 of the present invention.

An embodiment of wall framing system 110 therefore includes one or more stud members 118 extending substantially vertically between upper and lower frame channel members 114, 116. The combination provides a framework for constructing interior wall "$W_i$" in a simple and efficient manner. The interior wall "$W_i$" supported by wall framing system 110 may be quickly constructed with a consistent gap 119 between exterior wall "W" and the insulation members 199. As described above, gap 119 maintains an air space between interior wall "$W_i$" and exterior wall "W", as specified by building science best practices, and to establish a capillary break between exterior wall "W" and interior wall "$W_i$". Gap 119 also keeps insulation members 199 out of contact with moisture that may form at inner surface 100 of exterior wall "W" as the result of condensation, leakage, or the like. Insulation members 199 of interior wall "$W_i$" therefore remain dry and perform as intended with a relatively high R-value.

In addition to easily and efficiently establishing a desired gap 119, wall framing system 110 is also advantageous over conventional wall framing systems, in that the components of wall framing system, including upper and lower frame channel members 114, 116 and stud members 118, may be manufactured from an inorganic material that is resistant to degradation as a result of moisture exposure, and does not support bioorganism growth such as mold or mildew. In some embodiments, the components of wall framing system 110 may be manufactured as extruded or pultruded polyurethane resin plastic units, which may contain or be composed entirely of recycled material, including recycled plastics. The molded plastic units exhibit enhanced thermal insulation over conventional metal framing systems, and are relatively lightweight for ease of handling by the installer.

Applicants contemplate that the components of wall framing system may be sourced individually, or may be packaged together in pre-defined kits, which include all the components necessary to construct an interior wall or wall section "$W_i$" of predetermined size. For example, a wall framing kit may include a wall framing system 110 that is specifically designed to support the construction of an interior wall "$W_i$" that has an overall height "$H_o$" of 8 ft, a length "$L_o$" of 8 ft, and a depth "$D_o$" of about 4 in. Such kit may include one of each of upper and lower frame channel members 114, 116 having a length of 8 ft and a channel width capable of engagably receiving stud members 118 having a width of about 4 in. Such kit further includes five standard stud members 118 and two end stud members 117, with each end stud member being installable to opposed terminal ends of upper and lower frame channel members 114, 116, and the standard stud members 118 being installable between upper and lower frame channel members 114, 116 in spaced apart relationship with an appropriate spacing along the length dimension "L" of, for example, about 16 inches on center. Such kit may further include six substantially identical insulation members 199, each having a standard thickness of, for example, 2 in, a height dimension of about 8 ft, and a length dimension of about 16 in, so as to be secured between adjacent stud members 117, 118 in respective major or minor receptacles, and between upper and lower frame channel members 114, 116. The kit may further include fasteners 502, 522 for securing upper and lower frame channel members 114, 116 and stud members 117, 118 to the floor "F", exterior wall "W" and/or the ceiling. The kit may additionally include spacer blocks 524, wall board 516, and fasteners 518.

A kit as described above provides for the simple construction of an interior wall or wall section "$W_i$" which, in some cases, may be performed without separate fasteners or tools. This approach lends itself to use by non-professional builders, such as homeowners performing "do-it yourself" home improvements. In some embodiments, upper and lower frame channel members 114, 116 and stud members 117, 118 are symmetrically configured so as to be nestable in packaging and shipment. In this manner, the packaging and shipping of wall framing system 110 may be accomplished at significantly reduced cost as compared to conventional framing systems.

The invention has been described herein in considerable detail in order to comply with the patent statutes, and to provide this skilled in the art with the information needed to apply the novel principles and to construct and use embodiments of the invention as required. However, it is to be understood that the invention can be carried out by different methods/devices, and that various modifications can be accomplished without departing from the scope of the invention itself.

What is claimed is:

1. A method for constructing an interior wall in spaced proximity to an exterior wall of a building, said method comprising:

(a) providing a wall framing system having:

(i) upper and lower frame channel members each having a base portion extending between an inner brace portion and an outer brace portion and along a length of said frame channel member, wherein said inner and outer brace portions extend substantially perpendicularly from said base portion in a common first direction to define a channel therebetween, and a first stand off portion extending outwardly in a second direction from said outer brace portion by a first dimension to an outer end;

(ii) a plurality of substantially I-shaped stud members each having first and second ends, substantially parallel outer and inner flanges connected by a web portion, and a major divider portion extending substantially in parallel to said outer and inner flanges from a central region of said web portion to define a plurality of distinct major receptacles between said outer and inner flanges wherein a first major receptacle has a first width defined between said outer flange and said major divider portion, and a second major receptacle has a second width defined between said inner flange and said major divider portion, and a first minor divider portion extending substantially in parallel to said major divider portion between said major divider portion and one of said outer and inner flanges from said web portion to define a plurality of distinct first minor receptacles between said major divider portion and the respective one of said outer and inner flanges, and a second minor divider portion extending substantially in parallel to said major divider portion between said major divider portion and another of said outer and inner flanges from said web portion to define a plurality of distinct second minor receptacles between said major divider portion and the respective another of said outer and inner flanges; and (iii) a rigid insulation member;

(b) arranging said upper and lower frame channel members in a spaced apart relationship with respective said channels facing one another, the spacing of said upper and lower frame channel members defining a wall height;

(c) abutting said outer ends of said stand off portions of said upper and lower frame channel members against the exterior wall to space said respective outer brace portions inwardly from the exterior wall by said first dimension;

(d) installing said first and second ends of said stud members into said channels of respective said upper and lower frame channel members, with said outer and inner brace portions of said upper and lower frame channel members interacting with respective said outer and inner flanges of said stud members to secure said stud members to said upper and lower frame channel members in spaced apart relationship along said length; and (e) securing said rigid insulation member to adjacent spaced apart stud members and said upper and lower frame channel members by frictionally engaging said insulation member into respective major receptacles of said adjacently spaced apart stud members, and into respective channels of said upper and lower frame channel members, wherein a gap of predetermined gap dimension is established between said rigid insulation member and the exterior wall, based on said first dimension.

2. A method as in claim 1, including securing said rigid insulation member to adjacent spaced apart stud members and said upper and lower frame channel members by penetrating said first minor divider portions of said adjacent spaced apart stud members into said rigid insulation member.

3. A method as in claim 1 wherein said first and second widths are different.

4. A method as in claim 1, including frictionally securing said outer and inner flanges of said stud members to respective outer and inner brace portions of said upper and lower frame channel members.

5. A method as in claim 1, including a shoulder portion extending inwardly in a third direction substantially opposite to said second direction from said inner brace portion of said lower frame channel member by a second dimension, and having an extension portion extending from said inner brace portion to an interior end, and a cover portion extending from said interior end substantially in parallel to said inner brace portion to define an inner channel between said inner brace portion, said extension portion, and said cover portion.

6. A method as in claim 5, including mounting a wall board upon said extension portion of said shoulder portion.

* * * * *